United States Patent [19]

Forsythe

[11] Patent Number: 5,035,234

[45] Date of Patent: Jul. 30, 1991

[54] METHOD FOR FUNCTIONAL EVALUATION AND EXERCISING THE BACK MUSCLES OF A PERSON

[76] Inventor: Kenneth D. Forsythe, 307 Montana Ave., (Suite 302), Santa Monica, Calif. 90403

[21] Appl. No.: 231,054

[22] Filed: Aug. 11, 1988

[51] Int. Cl.[5] ..... A61H 1/02; A63B 21/00

[52] U.S. Cl. ..... 128/25 R; 272/134

[58] Field of Search ..... 128/25 R, 69–74, 128/70–74; 272/144, 134, 129, 125, 903; 269/322, 328

[56] References Cited

U.S. PATENT DOCUMENTS

| | | | |
|---|---|---|---|
| 1,076,475 | 10/1913 | Albright | 128/74 |
| 2,700,779 | 2/1955 | Tolkowsky | 128/70 X |
| 3,012,776 | 12/1961 | Hotas | 272/134 X |
| 4,725,056 | 2/1988 | Rehrl et al. | 272/144 X |

OTHER PUBLICATIONS

Biochex; 1986; 272-125; 6 pages.

*Primary Examiner*—V. Millin
*Assistant Examiner*—Linda C. M. Dvorak
*Attorney, Agent, or Firm*—Plante, Strauss, Vanderburgh and Connors

[57] ABSTRACT

Disclosed is a back exerciser including a table having first and second separate, but adjacent sections aligned with each other so that the first section supports the torso of the person reclining on the table and the second section supports the lower body of such person. The second section is mounted to rotate about a vertical axis which is nearest the first section and positioned so that, with the person reclining on his or her sdiee on the table, the vertical axis intersects the greater trochanter of the person's leg. Means for securing the person to the table so that said person, while reclining on his or her side, may cause the second section to rotate about a vertical axis by bending the lower body relative to the torso. The second section is adapted to rotate either clockwise or counterclockwise about a vertical axis. A dynamometer is coupled to the table for measuring the muscular performance of the person's back muscles during rotation of the second section.

2 Claims, 4 Drawing Sheets

METHOD FOR FUNCTIONAL EVALUATION AND EXERCISING THE BACK MUSCLES OF A PERSON

BACKGROUND OF THE INVENTION

1. Field of the Invention

This invention relates to an exercise device, and in particular, an exercise device which is used to exercise one's back in a safe manner for therapeutic purposes and also to measure, for example, the torque generated by the muscles so exercised.

2. Background Discussion

There is a need for equipment which will safely measure the work, power, endurance and torque generated by the human back muscles during exercise. Insufficient data now makes it extremely difficult to determine what is the normal performance of back muscles for patients of differing sizes and weights. Ideally, a back exerciser coupled to suitable electronic measuring and recording instrumentation would enable one to collect data on the normal performance of back muscles from a broad sampling of patients and then use this data in evaluating an individual patient's performance under similar test conditions.

Conventional back exercisers which are currently being sold are designed so that the person using the exerciser assumes a generally vertical position and bends at the waist. During exercise musclar performance of the back muscles is measured by a conventional dynamometer. Torque, power, work and endurance are measured and recorded, and these measurements provide quantitative data indicating how the back muscles are performing and this data is then analyzed to functionally evaluate the condition of the person's back muscles.

There are two problems associated with such conventional exercisers. First, as soon as the person begins, to bend at the waist, the weight of the apparatus, once the apparatus moves off the vertical, becomes a factor which prevents an accurate measurement. The heavier the equipment, the greater the momentum generated by the person bending at the waist. This momentum prevents obtaining a truly accurate measurement of the muscular performance. Secondly, because the person has assumed a vertical position and then bends to move from this vertical position, carrying the exercise equipment on his back, the weight of the exercise equipment could cause injury. In other words, the person may strain his or her back muscles which are being stretched under the weight of the exercise equipment and the weight of the torso.

BRIEF DESCRIPTION OF THE INVENTION

I have now invented a back exerciser which minimizes the influence of momentum in measuring torque, work, power and endurance, and is designed to enable the person using it to assume a horizontal position so that the weight of the equipment will not cause injury to the person's back during use of the exerciser.

This exerciser includes a generally flat table on which the person using the exerciser reclines on his or her side in a generally horizontal position. The table has first and second separate, but adjacent, sections. These sections are aligned with each other, so that the first section supports the torso of the person reclining on the table and the second section supports the lower body of such person. The second section is mounted to rotate about a vertical axis in either a clockwise or counter-clockwise direction. The mounting means are adjacent the end of the second section nearest the first section and positioned so that, with the person reclining on his or her side on the table, the vertical axis intersects the greater trochanters of the person's legs. I have found that the person's torso will tend to bend about an axis running through the greater trochanters rather than further up the spine. Thus, the normal axis about which a person bends his or her torso with respect to the lower body is one which intersects the greater trochanters of the legs of the person. This is the preferred axis of rotation, however, the body may be positioned with the axis of rotation at any point so as to evaluate the functional abilities of various segments of the spine.

The exerciser includes back supports removably attached to the top of the table which brace the back of the person reclining on the table. These supports include straps for securing the person to the table so that, while reclining, the person may cause the second section to rotate about the vertical axis by bending the lower body relative to the torso. The person may bend so that there is flexing of the muscles, causing the table to rotate about the axis in one direction, and then extend his muscles and legs backward to cause the table to rotate in an opposite direction until the muscles are in extension. Thus, the muscles can be both exercised in flexion and extension. The same back muscles are exercised when either the torso is moved and the legs remain stationary, or the legs are moved and the torso remains stationary. I employ the latter approach in the preferred embodiment of my invention, because the lower body portion has a lower mass and therefore the effects of momentum will be minimized.

Also in accordance with the preferred embodiment of my invention, a dynamometer is connected to the table for measuring muscular performance of the person during rotation of the second section of the table. People of different sizes generate, for example, different torques under different conditions and the dynamometer is the device used to measure these torques. A conventional isokinetic dynamometer is employed. The person will generate a torque during use of the exerciser and this torque is measured and displayed on a suitable chart paper or video display, thus providing a visual indication of the numerical value of the torque. This torque measurement is useful in diagnosing back ailments and injuries as well as characterizing the type of athletic skills a person may have because of his unique muscular condition or development.

The back exerciser of this invention has several advantages. First, it is relatively lightweight and the momentum generated during use is not as great a factor in influencing the measurement of muscular performance as conventional equipment. Secondly, and most importantly, because the person using the equipment is in the horizontal position and also due to the low momentum, the back exerciser of this invention is inherently safe. This is so because the person does not have to be concerned with overcoming the weight of the apparatus and his or her torso in returning the equipment to its normal start position when he or she feels pain. With the exerciser of the present invention, if the user experiences any pain or discomfort, he or she merely stops proceeding with the exercise. With conventional equipment where the user starts the bending exercise from a vertical position, once the commitment is made to bend, the person ultimately has to again return the equipment to its normal vertical position. In doing this he or she must overcome the weight of the equipment and the torso. Therefore, the user cannot stop during the middle of the exercise. The is not the case with the back exerciser of the present invention.

BRIEF DESCRIPTION OF THE DRAWING

The features of the present invention can best be understood, together with the advantages discussed above and other advantages, by reference to the following description taken in connection with the drawing wherein like numerals indicate like parts.

DETAILED DESCRIPTION OF THE DRAWING

Figure 1:
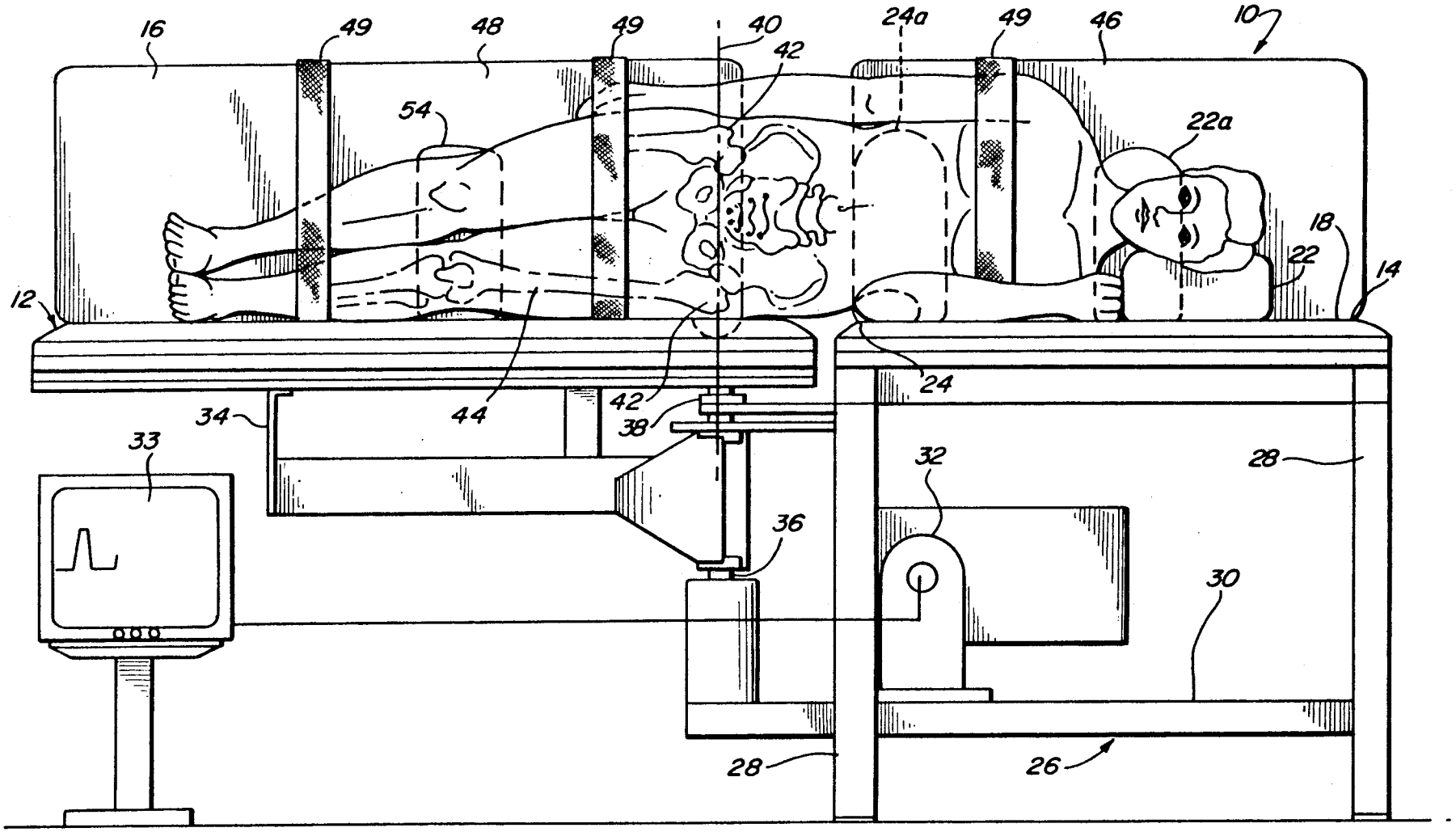
FIG. 1 is a side elevational view of the back exerciser of the present invention with a person using the exerciser reclining on his or her side on the top of the table of the apparatus.
Figure 2:
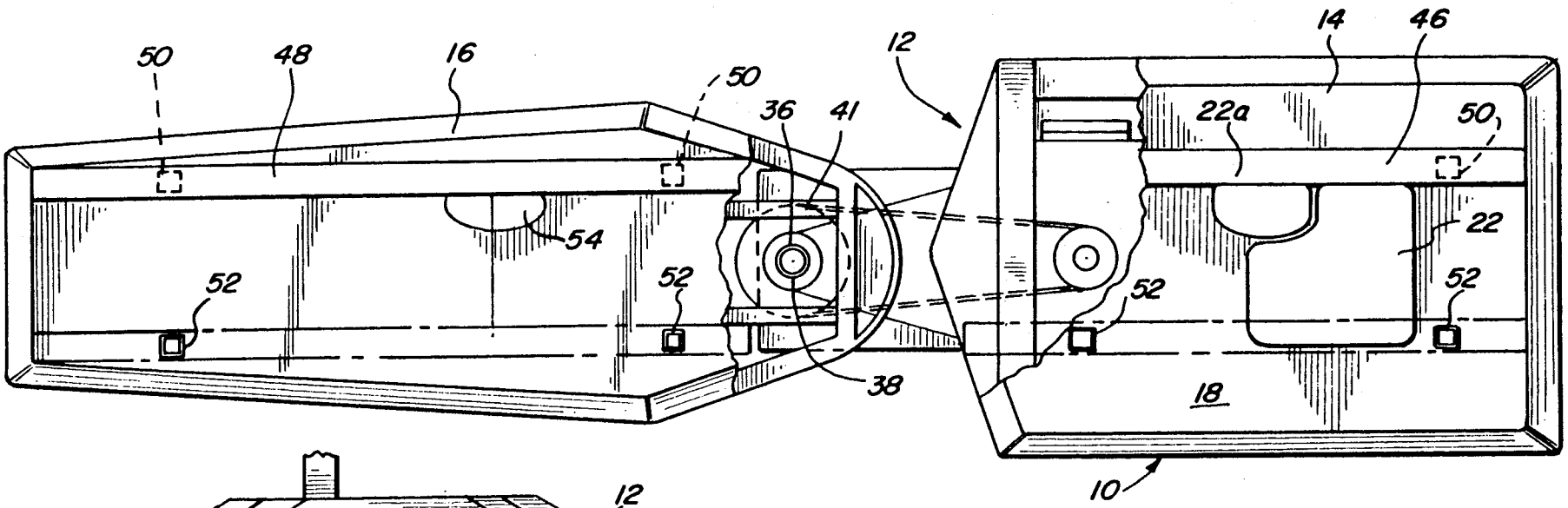
FIG. 2 is a plan view, with sections broken away, of the back exerciser of the present invention.
Figure 3:
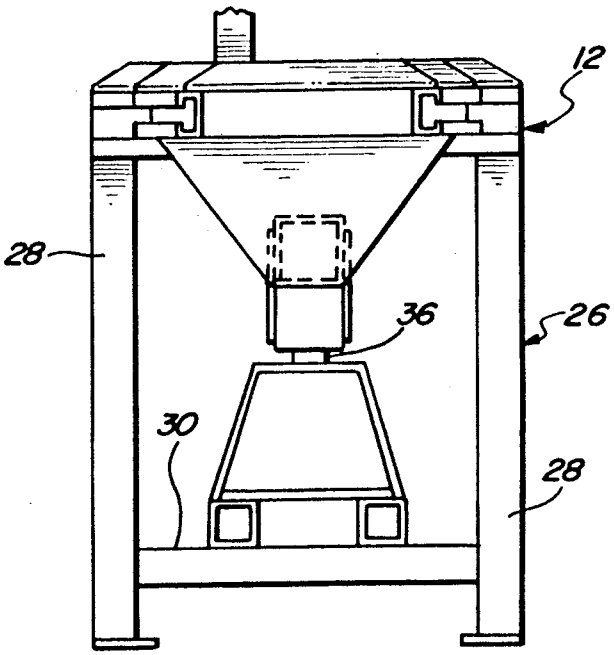
FIG. 3 is a side elevational view of the present invention showing the foot end of the table.
Figure 2A:
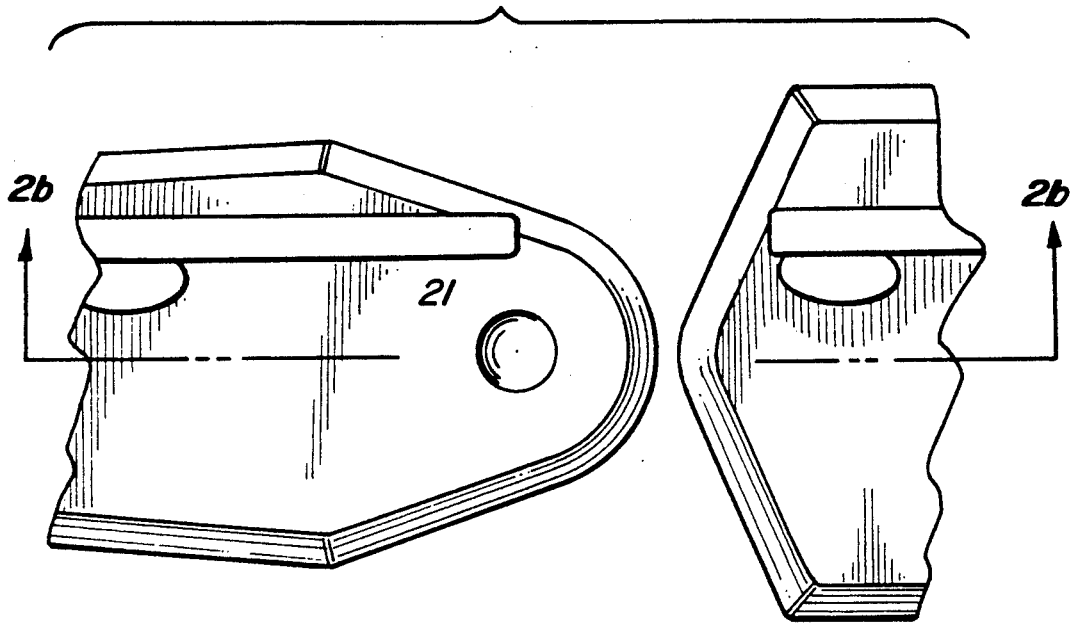
FIG. 2A is a plan view of the back exerciser of the present invention, showing the means for locating a person properly on the top of the exerciser.
Figure 2B:
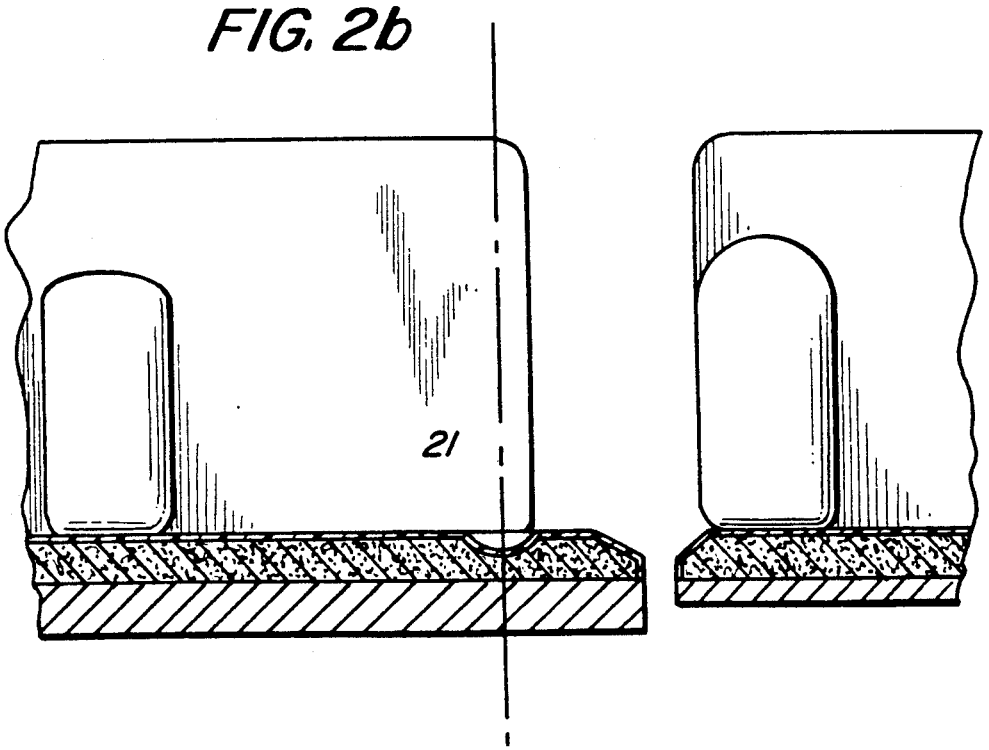
FIG. 2B is a cross-sectional view taken along 2B–2D.

As shown in FIGS. 1 and 2, the back exerciser 10 of this invention includes an elevated table 12 having two separate sections 14 and 16 which are adjacent and aligned with each other. The two sections 14 and 16 each include padded tops 18 and 20, respectively, with the top of sections having mounted thereon a headrest 22, including neck support **22*a*, and waist pillow 24, including back support 24*a*, at the appropriate positions to accommodate a person using the exerciser. The first section 14 supports the torso of the person reclining on the table 12 and the second section 16 supports the lower body of this person. The section 14 supporting the torso is carried on a stand 26 having vertical legs 28 which support the exerciser 10. A platform 30 extends between the legs of this section and is disposed below the table top 18. The platform 30 has secured to it, a dynamometer 32 which preferably is of the isokinetic type, such as sold by the Cybex Division of Lumex Corporation located in Ronkonkoma, N.Y. This type has a video display 33** where there is shown a graph depicting the torque generated by the back muscles during exercise. Also, U.S. Pat. Nos. 3,465,592 and 3,784,194 disclose suitable dynamometer.

The section 16 supporting the lower body has an under structure 34 which supports the section 16 and is mounted on a shaft 36 which extends upwardly from the platform 30 and into a bearing member 38 on the table. The section 16 is mounted to rotate either clockwise or counterclockwise about the vertical axis 40 of the shaft 36. A pulley 41 couples the shaft 36 to the input of the dynamometers.

As best depicted in FIG. 1, a person reclining on his or her side positions him/herself on the table so that the greater trochanters 42 of the femurs are aligned so that the vertical axis 40 of the shaft 36 intersects both of them. This vertical axis 40 is the bend line about which the person moves his or her torso relative to the lower body. The person, by positioning his or her body on the table 12 so that the greater trochanters of the femurs are directly over the shaft, insures that the axis of rotation is coextensive with the bend line.

To insure that a person is properly positioned on the table 12, there is provided in the padded top 20 an indentation 21 adapted to receive a person's trochanter when he or she is lying on his or her side. This indentation 21 is directly above the end of the shaft 36, with the axis 40 intersecting the center of the indentation. This indentation thus serves as a means for locating a person so that his or her trocanters are intersectingly aligned with the axis 40.

The two sections 14 and 16 are each equipped with back braces 46 and 48, respectively. Each back brace includes straps for attachably securing the person to the table and a pair of posts 50. There are two pairs of spaced holes 52 in the tops of the two sections, with only one pair shown in FIG. 2 because the post 50 of the braces 46 and 48 are inserted into the other pair. This enables the back braces 46 and 48 to be moved between the positions shown in solid lines to the positions shown in dotted lines. As will be discussed below in detail, this permits the person using the exerciser 10 to shift his or her body from one side to the other side. Preferably, a leg pillow 54 is placed behind the person's knees between his or her legs and the back brace 48.

Operation

To use the exerciser, one first reclines horizontally on his or her side on the table 12 as shown in FIG. 1, aligning him/herself so that the vertical axis 40 of rotation intersects the greater trochanters 42 of one's legs. The user has his or her back flush with the back braces 46 and 48 and is strapped into position by the straps 49 so that the user's body is secured to the back braces. This enables him or her to move or bend the lower body about the bend line running through the left and right greater trochanters of the femurs.

Figure 4:
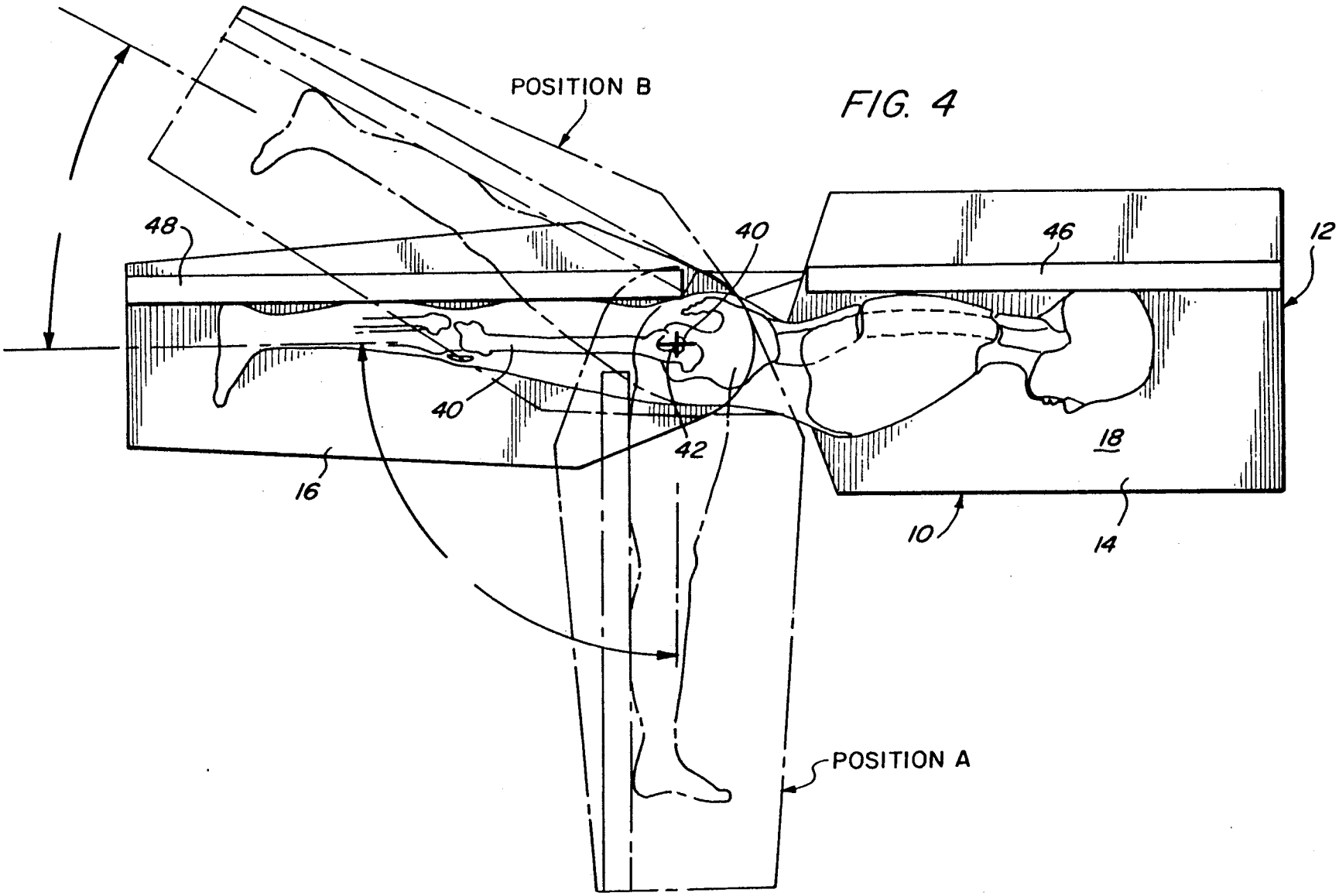
FIG. 4 is a simplified plan view of the exerciser of the present invention, with the dotted lines showing the person using it bending his or her body in extension and flexion.

As shown in FIG. 4, and identified as position A, the user bends about the bend line and exercises his or her back muscles in flexion. The user then rotates in an opposite direction, stretching his legs backward to extend his or her back muscles in extension as identified as position B. The dynamometer 32 measures the torque generated by this exercise, torque being simply the effectiveness of the force of the back muscles in setting the table into rotation. The torque is expressed in foot-pounds and is displayed on the video display 33 of the dynamometer.

The person is next unstrapped and then the back braces 46 and 48 are moved from the position shown in solid lines to the position shown in dotted lines. The person now turns on his or her opposite side, is again strapped onto the table 12 with her or her back against the braces, and now repeats the exercise. It is desirable to measure the torque generated with the person assuming a reclining position on both his left and right sides in order to get a more accurate measurement.

In accordance with one of the main features of this invention, if at any time the person using the exerciser 10 wishes to stop exercising, he or she may do so at any time without regard for the position of section 16. Thus, the exerciser is safe.

The above description presents the best mode contemplated of carrying out the present invention. This invention is, however, susceptible to modifications and alternative constructions from the embodiment shown in the drawing and described above. Consequently, it is not the intention to limit this invention to the particular embodiment disclosed. On the contrary, the intention is to cover all modifications and alternative constructions falling within the scope of the invention as expressed in the appended claims.

What is claimed is:

1. A method of exercising the body of a person comprising the steps of:

(a) providing a table having first and second separate but adjacent sections aligned with each other so that the of a person reclining on the table and the second section supports the lower body of such person, said second section being mounted to rotate about a vertical axis, and (b) positioning the body of the person on the table in a reclining posture on their side so that the greater trochanters of the legs of the person are aligned with said vertical axis, with said axis intersection said trochanters, and (c) with the person secured to the table, said person moving the second section of the table with the lower body to rotate said section about the vertical axis and bend the lower body relative to the torso, and thereby exercise the back of a person in a safe manner therapeutically.

2. The method of claim 1 wherein the second section is rotated about said vertical axis in both a clockwise and counterclockwise direction.

* * * * *